US011238702B2

(12) United States Patent
Johnson

(10) Patent No.: US 11,238,702 B2
(45) **Date of Patent: *Feb. 1, 2022**

(54) METHOD OF MODIFYING A PRIMARY GAME OF AN EXISTING LEGACY GAMING MACHINE TO INCLUDE SECONDARY AWARDS

(71) Applicant: Vulcan Gaming LLC, Buford, GA (US)

(72) Inventor: Sam Johnson, Largo, FL (US)

(73) Assignee: Vulcan Gaming LLC, Buford, GA (US)

( * ) Notice: Subject to any disclaimer, the term of this patent is extended or adjusted under 35 U.S.C. 154(b) by 1 day.

This patent is subject to a terminal disclaimer.

(21) Appl. No.: 16/838,862

(22) Filed: Apr. 2, 2020

(65) Prior Publication Data

US 2020/0234542 A1 Jul. 23, 2020

Related U.S. Application Data

(63) Continuation of application No. 15/271,208, filed on Sep. 20, 2016, now Pat. No. 10,614,667, and a (Continued)

(51) Int. Cl.
*G07F 17/32* (2006.01)

(52) U.S. Cl.
CPC ..... *G07F 17/3267* (2013.01); *G07F 17/3258* (2013.01)

(58) Field of Classification Search
CPC ..... G07F 17/3227; G07F 17/3255; G07F 17/3267; G07F 17/3258
See application file for complete search history.

(56) References Cited

U.S. PATENT DOCUMENTS 5,830,067 A 11/1998 Graves et al.
6,379,246 B1 4/2002 Dabrowski
(Continued)

FOREIGN PATENT DOCUMENTS

EP 1857987 11/2007
WO 2014047028 3/2014

OTHER PUBLICATIONS

International Search Report for PCT/US2013/060049, dated Dec. 20, 2013, 4 pages.

(Continued)

*Primary Examiner* — David L Lewis
*Assistant Examiner* — Robert E Mosser
(74) *Attorney, Agent, or Firm* — Weide & Miller, Ltd.

(57) ABSTRACT

Secondary gaming functionality is implemented relative to a casino gaming machine by a secondary controller which is associated with the gaming machine. In this manner, primary gaming functionality, such as primary wagering games and the award of primary awards and/or player reward points, may be implemented by the main game controller of the gaming machine. In addition, however, secondary gaming functionality may also be implemented at the gaming machine, such as secondary wagering games, secondary awards such as bonus and progressive awards and/or player reward points, via the secondary controller. The secondary controller may only implement secondary gaming functionality in response to a secondary wager placed by a player beyond a primary wager which enables the primary gaming functionality.

19 Claims, 7 Drawing Sheets

Related U.S. Application Data continuation-in-part of application No. 15/151,120, filed on May 10, 2016, now Pat. No. 10,607,441, which is a continuation-in-part of application No. 13/622,150, filed on Sep. 18, 2012, now Pat. No. 10,002,492.

(60) Provisional application No. 62/232,356, filed on Sep. 24, 2015.

(56) References Cited

U.S. PATENT DOCUMENTS

| | | | |
|---|---|---|---|
| 7,335,106 | B2 | 2/2008 | Johnson |
| 7,753,767 | B2 | 7/2010 | Thomas |
| 8,075,388 | B1 | 12/2011 | Bennett |
| 8,187,095 | B2 | 5/2012 | Wong et al. |
| 8,282,489 | B2 | 10/2012 | Arezina et al. |
| 8,529,328 | B2 | 9/2013 | Tarantino |
| 8,529,342 | B2 | 9/2013 | Tarantino |
| 8,721,449 | B2 | 5/2014 | Johnson |
| 8,900,057 | B2 | 12/2014 | Johnson |
| 8,932,130 | B2 | 1/2015 | Tarantino |
| 9,064,375 | B2 | 6/2015 | Johnson |
| 9,378,622 | B2 | 6/2016 | Tarantino |
| 9,564,004 | B2 | 2/2017 | Johnson |
| 9,619,964 | B2 | 4/2017 | Tarantino |
| 2002/0123376 | A1 | 9/2002 | Walker et al. |
| 2003/0087687 | A1 | 5/2003 | Locke et al. |
| 2004/0043814 | A1 | 3/2004 | Angell et al. |
| 2006/0025192 | A1 | 2/2006 | Walker et al. |
| 2006/0040743 | A1 | 2/2006 | Saffari et al. |
| 2006/0135255 | A1 | 6/2006 | Johnson |
| 2006/0205492 | A1 | 9/2006 | Linard et al. |
| 2007/0004519 | A1 | 1/2007 | Swart et al. |
| 2007/0021198 | A1 | 1/2007 | Muir et al. |
| 2007/0077997 | A1 | 4/2007 | Johnson |
| 2007/0155469 | A1 | 7/2007 | Johnson |
| 2007/0207850 | A1 | 9/2007 | Darrah et al. |
| 2008/0113773 | A1 | 5/2008 | Johnson et al. |
| 2008/0113802 | A1 | 5/2008 | Johnson et al. |
| 2008/0119253 | A1 | 5/2008 | Ryan et al. |
| 2008/0161107 | A1 | 7/2008 | Johnson |
| 2008/0300057 | A1 | 12/2008 | Kido |
| 2009/0061975 | A1 | 3/2009 | Ditchev |
| 2009/0247267 | A1 | 10/2009 | Acres |
| 2010/0004055 | A1 | 1/2010 | Gormley et al. |
| 2011/0028203 | A1 | 2/2011 | Agarwal et al. |
| 2011/0221745 | A1 | 9/2011 | Goldman et al. |
| 2011/0287828 | A1 | 12/2011 | Anderson et al. |
| 2012/0329549 | A1 | 12/2012 | Johnson |
| 2014/0080562 | A1 | 3/2014 | Johnson |

OTHER PUBLICATIONS

International Preliminary Report on Patentability for PCT/US2013/060049, dated Mar. 24, 2015, 8 pages.
International Search Report for PCT/US2013/059947; dated Dec. 13, 2013; 13 pages.
USPTO; OA U.S. Appl. No. 13/622,150; dated Mar. 11, 2015; 12 pages.
USPTO; OA U.S. Appl. No. 13/622,150; dated Oct. 26, 2015; 14 pages.
USPTO; OA U.S. Appl. No. 13/622,150; dated Jun. 6, 2016; 19 pages.
USPTO; OA U.S. Appl. No. 13/622,150; dated Jan. 11, 2017; 21 pages.
USPTO; NoA U.S. Appl. No. 13/622,150; dated Mar. 9, 2018; 7 pages.
USPTO; OA U.S. Appl. No. 13/799,356; dated Jul. 18, 2014; 6 pages.
USPTO; NoA U.S. Appl. No. 13/799,356; dated Oct. 14, 2014; 5 pages.
USPTO; OA U.S. Appl. No. 14/660,257; dated Jan. 21, 2016; 12 pages.
USPTO; NoA U.S. Appl. No. 14/660,257; dated Jul. 18, 2016; 5 pages.
USPTO; OA U.S. Appl. No. 15/271,208; dated Mar. 27, 2018; 26 pages.
USPTO; OA U.S. Appl. No. 15/271,208; dated Oct. 2, 2018; 21 pages.
USPTO; OA U.S. Appl. No. 15/139,510; dated Mar. 9, 2018; 13 pages.
USPTO; OA U.S. Appl. No. 15/139,510; dated Sep. 20, 2018; 28 pages.
USPTO; OA U.S. Appl. No. 15/151,120; dated Mar. 9, 2018; 19 pages.
USPTO; OA U.S. Appl. No. 15/151,120; dated Oct. 3, 2018; 16 pages.
USPTO; OA U.S. Appl. No. 15/343,363; dated Mar. 29, 2017; 9 pages.
USPTO; NoA U.S. Appl. No. 15/343,363; dated Feb. 21, 2018; 5 pages.
USPTO; OA U.S. Appl. No. 15/984,773; dated Sep. 14, 2018; 10 pages.
USPTO; OA U.S. Appl. No. 16/423,338; dated Mar. 18, 2020; 6 pages.
USPTO; NoA U.S. Appl. No. 16/423,338; dated Aug. 10, 2020; 8 pages.
USPTO; OA U.S. Appl. No. 16/424,844; dated Apr. 24, 2020; 5 pages.
USPTO; NoA U.S. Appl. No. 16/424,844; dated Aug. 31, 2020; 5 pages.

METHOD OF MODIFYING A PRIMARY GAME OF AN EXISTING LEGACY GAMING MACHINE TO INCLUDE SECONDARY AWARDS

RELATED APPLICATION DATA

The present application is a continuation of U.S. application Ser. No. 15/271,208, filed Sep. 20, 2016, now U.S. Pat. No. 10,614,667, which claims priority to U.S. Provisional Application Ser. No. 62/223,356, filed Sep. 24, 2015, and which is also a continuation-in-part of U.S. patent application Ser. No. 15/151,120, filed May 10, 2016, now U.S. Pat. No. 10,607,441, which is a continuation-in-part of U.S. application Ser. No. 13/622,150, filed Sep. 18, 2012, now U.S. Pat. No. 10,002,492. These prior applications are incorporated by reference as if set forth fully herein.

FIELD OF THE INVENTION

The present invention relates to casino-style gaming machines.

BACKGROUND OF THE INVENTION

Wager-based gaming continues to grow in popularity. In order to attract players, casinos and gaming device manufacturers continuously seek to develop new games and other amusing or entertaining events. In this regard, gaming device manufacturers develop and release hundreds of new wagering games each year, which new gaming machines may present entirely new games or may present old games using new entertaining themes. These and other traditional gaming machines are custom created to have specific functionality. As a result, casinos have to either buy new machines or have existing machines reprogrammed to upgrade the machines with new features. Each alternative is expensive.

It would be beneficial for gaming device manufacturers and casinos to have a more economical way to introduce new games and other gaming device features.

SUMMARY OF THE INVENTION

Secondary gaming functionality is provided for a casino gaming machine which is configured to implement primary gaming functionality via a main game controller, by a secondary controller which is associated with the casino gaming machine. The secondary controller may be configured to implement the secondary gaming functionality based upon a secondary wager, whereby the player places a primary wager to enable the primary gaming functionality and an additional secondary wager to enable the secondary gaming functionality. The secondary gaming functionality may comprise, but is not limited to: (1) the play of one or more secondary games or other events, such as bonus games, independent secondary games or secondary games or events which are linked to a primary game; (2) bonus award opportunities, such as increased payouts for winning primary game outcomes; and/or (3) the award of non-monetary reward points.

In one embodiment, the secondary gaming functionality may function to provide a multi-game experience at the gaming machine or remotely at another gaming machine or other device, e.g., a smart phone, tablet, personal computer, and the like. The multi-game experience may comprise one or more additional instances of a wager-based video game provided by the primary gaming functionality of the gaming machine. The secondary gaming functionality of the gaming machine may cause the one or more additional instances of the wager-based video game to be presented at another device either directly or indirectly via a server, such as a social media server or a server-based gaming system's server. The secondary gaming functionality may provide betting scenarios other, additional than those provided by the primary gaming functionality, which betting scenarios may permit the player to wager on a wager-based video game provided by the primary gaming functionality.

In accordance with one or more embodiments, a modified gaming machine comprises a plurality of gaming machine peripheral devices including at least one video display and at least one player input device, a main game controller and a secondary controller. The main game controller is configured to implement primary gaming functionality, and is configured to generate and transmit information to the plurality of gaming machine peripheral devices. The secondary controller is interposed between one or more of the plurality of gaming machine peripheral devices and the main game controller. The secondary controller may forward information generated by the main gaming controller to one or more of the plurality of gaming machine peripheral devices and transmit secondary information to one or more of the peripheral devices. In response to receiving a secondary gaming functionality request input via at least one of the plurality of gaming machine peripheral devices, the secondary controller causes secondary gaming functionality to be generated/presented (at the gaming machine or elsewhere, as detailed below) in addition to the primary gaming functionality provided by the main game controller.

In accordance with one or more embodiments, the primary gaming functionality provides a primary instance of a wager-based video game and the secondary gaming functionality provides at least one secondary instance of the wager-based video game provided in addition to the primary wager-based video game. By way of a non-limiting example, the wager-based video game may be video poker game, video slot game, etc.

In accordance with one or more embodiments, the primary gaming functionality provides a wager-based video game and the secondary gaming functionality provides multiple independent simultaneous betting opportunities on the wager-based video game.

In accordance with one or more embodiments, the secondary gaming functionality may be invoked in response to a hold operation on at least one card in a primary video poker hand, and at least one additional video poker hand is presented. The additional video poker hand may or may not include a held card. Alternatively, the secondary gaming functionality may be invoked in response to any type of input by the user indicating a desire to access a multi-game experience, or a multi-wagering experience. In accordance with one or more embodiments, the secondary gaming functionality may provide a bonus video poker hand as part of a multi-game experience c in connection with a primary video poker game.

In accordance with one or more embodiments, the primary gaming functionality may provide a primary video slot game and the secondary gaming functionality may provide at least one additional video slot game. A symbol from the primary video slot game may be used in the at least one additional video slot game.

In accordance with one or more embodiments, the primary gaming functionality may provide a primary instance of a wager-based video game and, in response to input indicating a player's desire to for a multi-game experience, the secondary gaming functionality may provide at least one secondary instance of the wager-based video game provided in addition to the primary instance of the wager-based video game. The primary gaming functionality may provide a primary video poker hand and the secondary gaming functionality may provide at least one additional video poker hand without using any card from the primary video poker hand.

In accordance with another embodiment of the invention, a secondary controller may be configured to implement secondary gaming functionality in the form of secondary or additional awards or bonusing opportunities at a gaming machine, e.g. awards above and beyond or different from those which are offered as part of play of the base games which are presented by the gaming machine. Such awards might fixed or variable/progressive values, a multiplier of a base win value or the like and may be awarded if a player places a required secondary wager and secondary bonus winning criteria are met, such as receipt of a particular base game outcome.

As one example, a player might place a base game wager to play a base video poker game and might place a secondary credit wager to participate in a progressive Royal Flush bonus via the secondary controller. If the player receives a Royal Flush winning hand, the player would receive winnings in primary credits in accordance with the pay table for the base game and could win a bonus award in primary or secondary credits via the secondary controller The at least one secondary wager-based video game may be provided at the modified gaming machine, or via an external server, such as a social media server or a gaming system server. Where the external server is a social media server, the secondary instances of the wager-based video game may be presented to a player's social media friends. Where the external server is a gaming system server, the at least one secondary instance of a wager-based video game to be provided via the gaming system server. In accordance with one or more embodiments, the secondary controller may cause at least one secondary instance of a wager-based video game to be provided via another modified gaming machine.

Further objects, features, and advantages of the present invention over the prior art will become apparent from the detailed description of the drawings which follows, when considered with the attached figures.

DETAILED DESCRIPTION OF THE INVENTION

Figure 1:
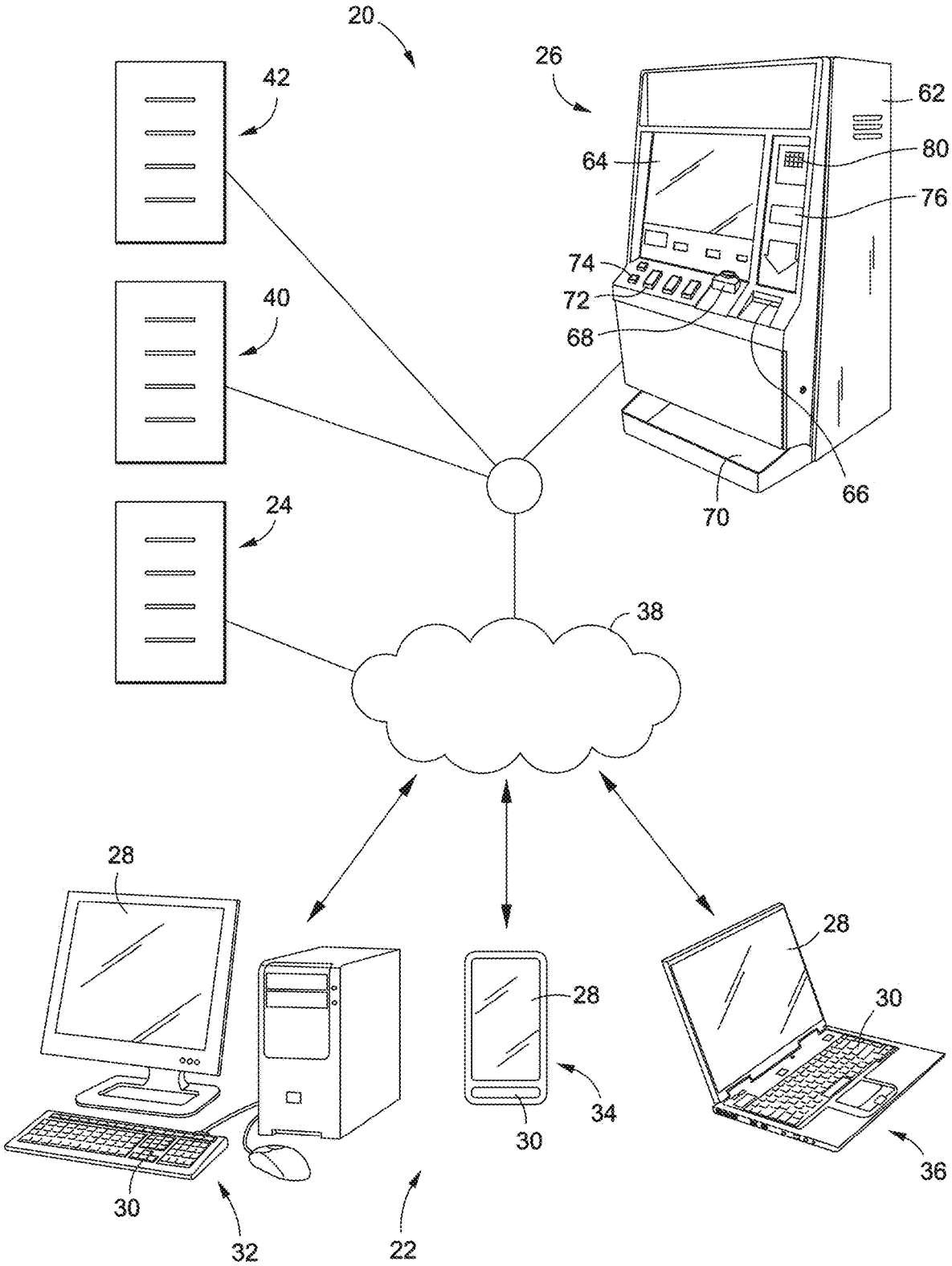
FIG. 1 diagrammatically illustrates a gaming system including one or more presentation devices and at least one casino gaming machines.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In accordance with one or more embodiments of the invention, a modified gaming machine is provided, which gaming machine comprises a master gaming controller that provides a primary instance of a wager-based video game, such as without limitation wager-based video poker, and a secondary controller configured to provide secondary gaming functionality, such as one or more separate second games, one or more second linked games and/or one or more secondary awards such as bonuses or progressives. In accordance with one or more such embodiments, the secondary gaming functionality may be provided together with the primary instance at the modified gaming machine and/or another device, such as at a user's computing device that is communicatively linked, e.g., via one or more networks and networked server computers, with the modified gaming machine. In accordance with one or more embodiments, the secondary gaming functionality may be provided at a player's computing device, e.g., via at least one social media system server or a server-based gaming system. The secondary controller may be communicatively coupled, via one or more networks, to one or more servers, so as to provide instances of the modified gaming machine's wager-based game(s) to another gaming machine, e.g., another modified gaming machine, or any computing device to which the secondary controller is able to communicate via the network(s) and server(s).

By way of a non-limiting example, in a case that the modified gaming machine is configured to provide primary and secondary instances of a wager-based video-poker game, the secondary controller may, in response to user input, cause the modified gaming machine to use one or more cards from the primary instance of the video poker game to spawn one or more additional instances of the video poker game. In such a case, each additional, or secondary, video poker hand includes the one or more cards from the primary game, e.g., one or more cards held by the player in the primary game. The modified gaming machine gives the user, or player, the ability to play multiple games even though the primary game provided by the master gaming controller is not configured to provide multiple games.

As a further non-limiting example, while one or more additional games may be spawned from the primary game in response to player input, e.g., in response to the player holding a card in the primary game, the one or more cards held by the player are not used in the one or more additional hands.

In accordance with one or more embodiments, the modified gaming machine comprising the secondary controller provides the player with a multi-game experience, which would not otherwise be available with an unmodified gaming machine, i.e., a gaming machine that lacks the secondary controller.

As another non-limiting example, the secondary controller may implement one or more secondary awards, such as a secondary award, bonus, jackpot, progressive jackpot, multiplier or other type of award. The secondary award may be associated with one or more primary games, such as being triggered or awarded for certain primary game outcomes or events.

Reference is now made to FIG. 1, which illustrates a system which may include a modified gaming machine and one or more presentation devices, among other components. As is discussed further below, a presentation device may be a player's computing device, which may be located in a remote location with respect to the modified gaming machine.

As illustrated in FIG. 1, in one embodiment, a system 20 comprises one or more presentation devices 22 (it being understood that while there may be two or more presentation devices 22, for convenience herein, the system is primarily described relative to a player's use of a "presentation device 22") and at least one casino gaming machine 26.

The presentation device 22 may be a dedicated/special purpose device or may be a general purpose device. The presentation device 22 is preferably an electronic device, and more preferably a computing device. The presentation device 22 may include at least one video display 28 capable of displaying game information, at least one player input device 30, and at least one communication interface.

The presentation device 22 might comprise, for example, a desktop computer 32, a telephone (including cellular, wireless or wired telephones) or PDA 34 (such as an iPhone®), a laptop or notebook computer 36, or various other devices. As indicated, the presentation device 22 might also comprise a special purpose device such as a specially configured gaming tablet.

The player input device 30 might comprise, for example, a keyboard, mouse, joystick, touch-screen, button(s), trackballs or other devices now known or later configured and which are capable of receiving input from a player. The communication interface is preferably configured to permit information or data to be exchanged from one or more remote device or locations with the presentation device 22. The one or more communication interface might support wired or wireless communications using various protocols. For example, if the presentation device 22 is a PDA, the communications might be by 3G, 4G, IMT, GSM or the like. If the presentation device 22 is a desktop computer, the communications might be by TCP/IP or the like. Of course, other protocols may be used such as Bluetooth, 802.11xx and the like.

It will be appreciated that the presentation device 22 may include other components. For example, the presentation device 22 may include a main processor, a video and/or audio processor, input and output ports or the like.

As indicated above, the system 20 preferably also includes one or more gaming machines 26. In a preferred embodiment, the gaming machines 26 are traditional casino-style gaming machines which are located at a casino (and as such are referred to as "casino gaming machines"). As described below, the casino gaming machines 26 may be part of a gaming system, such as a casino gaming system which links multiple of the gaming machines, one or more table games and other devices such as kiosks, accounting systems or servers, progressive systems or servers, player tracking systems or servers or the like.

Such traditional casino-style gaming machines 26 may have a plurality of features. For example, such a traditional casino gaming machine 26 may include a housing or cabinet 62 for enclosing/supporting various components of the gaming machine. The housing 62 may have a variety of configurations. In one embodiment, as illustrated, the housing 62 is configured so that the machine has an "upright" configuration. The casino gaming machine 26 might also be configured as a "slant"-type, "bar-top" or have other forms.

In one embodiment, the casino gaming machine 26 may be configured as a "video" type gaming machine, the machine including at least one display 64 for displaying game information to a player. The casino gaming machine 26 may include other means for providing information to a player. For example, speakers (not shown) or other devices may be provided for generating sound associated with the game. The casino gaming machine 26 may also include lights, printed instructions and other displays/display devices.

The games presented by the gaming machine(s) may be wagering type games wherein a player must place a bet or wager in order to play the game for the opportunity to receive winnings. As described below, a player may be required to associate monetary value with the gaming machine via one or more monetary value accepting devices or mechanisms in order create a player credit balance, and from which balance the player places wagers (thus reducing the credit balance). Preferably, if the player is a winner of the game, the player is provided an award, such as an award of credits which increases the player's credit balance (although the award could be a direct monetary payout (such as coins or currency), points or tangible prizes). As illustrated, the casino gaming machine 26 may thus include one or more of a bill validator/acceptor 66 for accepting paper currency, a coin acceptor 68 for accepting coins or other means or mechanisms for accepting payment or monetary value, such as a credit card reader.

Preferably, the casino gaming machine 26 includes means for a player to provide input. In one embodiment, this means comprises one or more buttons. For example, a "spin" button 72 may be provided for permitting a player to start a game. One or more wager buttons 74 may be provided for a player to select the amount to bet on a particular game. Other means of input may be provided, such as a touch-screen display and other devices now known or later developed.

A main game controller (not shown) is provided for controlling the various devices of the gaming machine and for generating game information. The main game controller may comprise a processor which is configured to execute machine readable code or "software", which software may, for example, be stored (e.g. fix in a non-transitory state) at one or more associated memory devices (such as a hard driver, EEPROM, RAM or other data storage devices now known or later developed). For example, the game controller may be arranged to generate video and audio data for presentation by the display and speakers of the casino gaming machine 26.

The game controller may be arranged to detect a signal from the coin acceptor indicating the receipt of coins or from the bill validator regarding accepted bills and for registering credits corresponding to those inputs (e.g. creating a player credit balance), for subtracting credits for wagers placed by a player, and for dispensing or paying out credits upon cash-out (such as by transferring the credits or the monetary value thereof to a remote financial account, to write information to a card, ticket or other media via a writing or printing device, for causing a coin delivery mechanism to deliver coins from a coin hopper to the coin tray 70, and/or for causing a currency dispensing mechanism to dispense currency). Preferably, the one or more player input devices provide an output to the gaming controller for use in play of the game. For example, in response to a "bet one" input by a player, the gaming controller is preferably transmitted a signal which causes the gaming controller to initiate presentation of the game (based upon a wager of a single credit which is deducted from the player's credit balance).

The casino gaming machine 26 may include one or more random number generators (such as implemented by a random number generator software module stored in the memory and executable by the controller) for generating random game events and results (in a random fashion whereby the game is presented in a manner in which the player cannot control the outcome or a pseudo-random fashion such as where the game includes a skill component by which the player can affect the outcome of the game). In other embodiments, game results or information may be generated remotely (such as by a remote game server) and be transmitted to the gaming machine 26. It will be appreciated that the gaming machine 26 may be configured to present a wide variety of games which are now known or later developed, including card games such as poker and blackjack games, slot-type games, bingo games, keno games, sports wagering and other events or games.

As indicated, in one embodiment, game information is displayed by a video display 64 to a player. That display may be of a variety of types, including CRT, LCD, plasma and others. The gaming machine 26 may also include more than one video display.

In another embodiment, the casino gaming machine 26 may include one or more physical reels capable of displaying symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression of a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. As is well known, the combinations of reel positions and their odds of hitting are associated with the controller, and the controller is arranged to stop the reels in a position displaying a combination of indicia as determined by the controller based on the combinations and odds. The principal of such an arrangement is described in U.S. Pat. No. 4,448,419 to Telnaes, which is incorporated herein by reference. For example, the base symbols might be associated with spinning reels. Sets of base symbols might be generated by spinning those reels.

Such casino gaming machines 26 may have other configurations, including other features. For example, the casino gaming machine 26 may include a player tracking device, such as a card reader 76 and associated keypad 80. Such player tracking devices are well known and may permit the game operator to track play of players of the gaming machine. The tracked play may be utilized to offer player bonuses or awards.

In one embodiment, the casino gaming machine 26 may be configured to dispense media, such as printed paper tickets, which have associated value. For example, winnings or unused credits may be returned to the player via a printed ticket having value or associated value. In one embodiment, the casino gaming machine 26 might also be configured to accept such media for providing credit for game play. Relative to such casino gaming machines 26, an accounting server 40 may be used to generate ticket information to permit the gaming machine to dispense a value cash-out ticket, or to verify such a ticket which is presented at one of the casino gaming machines 26. Such systems are well known and thus not described in detail herein.

A casino may have numerous such casino gaming machines 26, such as located on a casino floor or in other locations. Of course, such casino gaming machines 26 might be used in other environments, such as an airport, a bar or tavern or other locations.

As used herein, the term "casino gaming machine" may include other types of gaming machines or device. Such might comprise, for example, gaming tables. Such tables may be manually operated or be fully or partially automated. A variety of games may be offered at such tables. Of course, the gaming machines may include other types of devices as well.

In a preferred embodiment, the invention has particular utility to gaming machines which include at least one player interface via which information may be presented or displayed to the player. Such an interface preferably comprises at least one electronic video display. Such a display might comprise, for example, a display of a gaming machine 26 such as described above, or such might comprise a display located at a gaming table or other device (including a display not originally associated with the original gaming machine).

As indicated above and as illustrated in FIG. 1, the system 20 of the invention may further comprise other systems and components. In one embodiment, the system 20 may further comprise the above-referenced accounting server/system 40 and/or a player tracking server/host/system 42 or the like.

The accounting server 40 may track monetary transactions, including information regarding monetary value provided by a player, amounts wagered by a player and amounts won by a player, such as described in more detail below. The accounting server 40 may a computing device which has a processor for executing instructions, a memory for storing data such as instructions and monetary value information, and at least one communication interface. The accounting server 40 may comprise one device or a number of devices which are in communication with one another at one or more times. For example, the accounting server 40 may communicate with an external data storage device. Additional details regarding the account server 40 are described below.

The player tracking server 42 may be configured to store player identity information and information regarding the player's gaming or other activities, as is well known. The player tracking server 42 may a computing device which has a processor for executing instructions, a memory for storing data such as instructions and monetary value information, and at least one communication interface. The player tracking server 42 may comprise one device or a number of devices which are in communication with one another at one or more times. For example, the player tracking server 42 may communicate with an external data storage device. Additional details regarding the player tracking server 42 are described below.

In one embodiment, various features of the invention may be implemented or facilitated by one or more secondary servers or other devices. For example, although not illustrated in FIG. 1, a casino might operate one or more casino servers. Such a server may serve as a bridge to facilitate the features of the invention.

In other embodiments, a casino gaming machine 26 may be modified to implement the features of the invention. Currently there are tens of thousands of existing casino gaming machines 26 which were custom-created to present specific games—e.g. the main controllers and associated software were designed to present one or more specified games. These gaming machines were not designed to permit new games or other content or features to be presented by the machine without essentially re-programming the entire gaming machine (which is generally undesirably expensive and/or effectively prohibitive, at least in part because such re-programming is generally not permissible without gaming regulatory approval and oversight, i.e. the manufacturer or operator of the machine cannot simply unilaterally install new software on the gaming machine). Such gaming machines are often referred to as "legacy" gaming machines.

In one embodiment, legacy gaming machines may be modified to implement the present invention. In a preferred embodiment of the invention, a gaming machine is retro-fit with a secondary controller. One embodiment of such a configuration is illustrated in FIG. 7.

Figure 7:
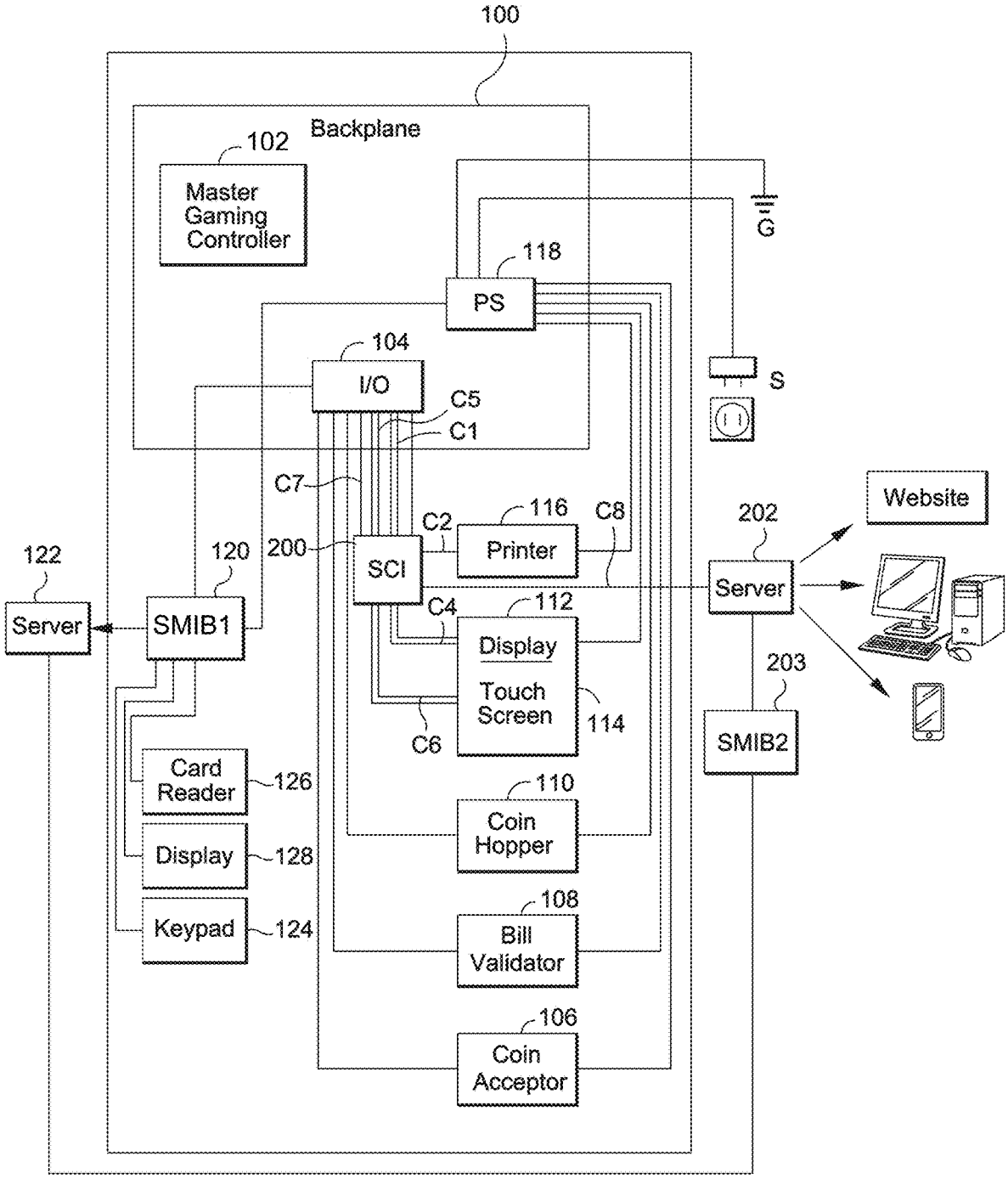
FIG. 7 diagrammatically illustrates one configuration of a casino gaming machine having a secondary interface for facilitating features of the invention.

As illustrated in FIG. 7, in one embodiment a legacy casino gaming machine has a backplane 100 which supports a main or master gaming controller 102. The master gaming controller 102 may comprise a computer processing unit and may include one or more associated components, such as memory devices or the like. In general, the master gaming controller 102 is configured to execute machine readable code for use in operating the gaming machine. For example, the master gaming controller 102 may generate signals used to control various components of the gaming machine and/or generate data for use by those components.

An input/output (I/O) board 104 is associated with the master gaming controller 102. The I/O board 104 may be part of the master gaming controller 102 or, as illustrated in FIG. 7, be connected to the backplane 100. The input/output board 104 may include various connectors or communication ports for use in connecting various components to the master gaming controller 102 (whereby the master gaming controller 102 may provide information, to the components, and/or receive information from those components). As used herein, the information or data may have any of a variety of forms now known or later developed, whether analog or digital, on/off, numeric, wave form or having any other configuration. The input/output board 104 may, for example, include one or more serial (such as RS-232), parallel, USB, Firewire® or other types of connections.

The gaming machine may include a variety of peripheral devices for use in presenting games to a player. For example, the gaming machine may include: a coin acceptor 106 for accepting coins for one or more wagers; a bill validator 108 for accepting paper currency, tickets or other printed documents representing value for one or more wagers; a coin hopper 110 for storing received coins and from which coin payouts may be paid; at least one display 112 for displaying game information, which display may have an associated touch screen 114 for receiving player touch input, and a printer 116 for printing tickets or other media. Of course, the gaming machine might have a wide variety of peripherals or other components, including buttons, rotatable arms, joysticks, trackballs, speakers and other devices.

As illustrated, each of these peripheral devices preferably communicates with the master gaming controller 102 via a communication connection through the I/O board 104 associated with the backplane 100. The particular connection might vary. For example, the printer 116 might be a USB-type device and thus interface with the I/O board 104 via a USB connection and associated port. The coin hopper 110, however, might be an RS-232 type device and connect to the I/O board 104 via a 9 pin connector. Preferably, the master gaming controller 102 can control these various peripheral devices via the communication connections therewith.

The various electrical or electro-mechanical devices of the gaming machine are powered. As illustrated, a power supply 118 may be associated with the backplane 100. The power supply 118 preferably connects to a ground G and an external power source S. The power supply 118 preferably provides power to the master gaming controller 102 and the various peripheral devices of the gaming machine, as illustrated. In one embodiment, the gaming machine may be configured to implement gaming machine accounting and player tracking functions. These operations may be facilitated by a Slot Machine Interface Board or "SMIB" 120. As illustrated, the SMIB 120 may connect to the master gaming controller 102 via the backplane 100, and may communicate with an external server 122 via a communication link. In one prior art configuration, the gaming machine may utilize a Slot Accounting Standard or "SAS" protocol in order to implement various gaming machine accounting functions (such as tracking of wagers, game wins and other information, as is known in the art). Due to the interface with the external server, the gaming machine accounting information may be obtained or tracked externally to the machine. The external server 122 might comprise a secondary accounting server or the like, or might comprise one or more of the player tracking server 42 or accounting server 40 that are communicatively linked to the main game controller.

In addition, the gaming machine may include a player tracking feature. The player tracking feature may be implemented via components such as a keypad 124, a card reader 126 for reading cards or other media, other peripheral devices, such as a display 128. The player tracking devices or components may interface with the SMIB 120, and thus with the external server 122 (such as the player tracking server 42 in FIG. 1). In this manner, information regarding a particular player's play may be tracked. For example, a player may insert a player card having player identification information associated therewith, and that information may be provided to the server 122/player tracking server 42. Thereafter, game play information may be provided to the server 122/player tracking server 42, as known to be associated with the particular player identified by the provided identification information.

For example, as described below, the legacy gaming machine may be configured to implement a player rewards program via the player tracking server 42. The master gaming controller 120 may be configured to transmit game play information such as credit balances, amounts wagered, game outcomes and the like, to the player tracking server 42. Reward points, such as non-monetary reward points (as opposed to monetary value credits) may be awarded by the player tracking server 42 based upon certain activity criteria (amounts wagered, winning or losing events, etc.), which points may be associated with a reward points balance associated with the player's account. Such points may be usable or redeemable by the player, such as for goods/services, free game play, etc., such as determined by the operator.

As just described, such an existing or "legacy" gaming machine is a fully integrated and pre-configured device for presenting one or more wagering games to a player. As indicated above, however, such a legacy gaming machine has a number of drawbacks owing to the specific configuration of the device.

In a preferred embodiment of the present invention, a secondary controller or interface (SCI) is provided which, when associated with a gaming machine, permits the gaming machine to provide additional or secondary functionality from its basic or pre-configured functionality. In one embodiment, the SCI is particularly suited to use with an existing gaming machine, including a gaming machine pre-configured in the manner illustrated in FIG. 1 and described above, or in a manner similar thereto.

The SCI, its method of use, its association with a gaming machine and system of the invention, will now be described first with reference to FIG. 7. For purposes of illustration, the SCI 200 is discussed in association with a gaming machine configured as illustrated in FIG. 1. Such a gaming machine may comprise an existing legacy machine having limited functionality.

The SCI 200 preferably comprises hardware, such as one or more circuit boards. The SCI 200 may comprise software, such as machine readable code. Such software, however, may be implemented as hardware.

In one embodiment, the SCI 200 is configured to communicate with one or more components of a gaming machine. As such, the SCI 200 includes one or more ports via which communication links may be established between the SCI 200 and those components. Referring to FIG. 7, in one embodiment, the SCI 200 is interposed between various of the components of the gaming machine and the I/O board 104, and thus the master gaming controller 102 (which receives information or signals from the I/O board 104 and provides information or signals to the I/O board 104). In this manner, the SCI 200 can monitor or override instructions or data provided to those components by the master gaming controller 102 and monitor or override instructions or data provided by those components and intended for the master gaming controller 102. In addition, the SCI 200 need not override instructions provided by the master gaming controller 102 or provided to the master gaming controller 102, but might monitor those instructions/data and then generate data or instructions for use in controlling or activating other components.

As illustrated, the SCI 200 is interposed between the I/O board 104 and the printer 116, the I/O board 104 and the display 112, and the I/O board 104 and the touch screen 114. The SCI 200 may be interposed between the I/O board 104 and other of the components. A first communication link C1 is provided between the SCI 200 and the I/O board 104. A second communication link C2 is provided between the SCI 200 and the printer 116. In combination, these communication links C1 and C2 permit the master gaming controller 102 to still communicate with the printer 116 through the SCI 200 (preferably as controlled or monitored by the SCI 200). In addition, however, this configuration permits the SCI 200 to communicate directly with the printer 116.

Similarly, a first communication link C3 is provided between the SCI 200 and the I/O board 104. A second communication link C4 is provided between the SCI 200 and the display 112. In combination, these communication links C3 and C4 permit the master gaming controller 102 to still communicate with the display 112 through the SCI 200 (preferably as controlled or monitored by the SCI 200). In addition, this configuration permits the SCI 200 to communicate directly with the display 112.

A first communication link C5 is provided between the SCI 200 and the I/O board 104. A second communication link C6 is provided between the SCI 200 and the touch screen 114. In combination, these communication links C5 and C6 permit the master gaming controller 102 to still communicate with the touch screen 114 though the SCI 200 (preferably as controlled or monitored by the SCI). In addition, this configuration permits the SCI 200 to communicate directly with the touch screen 114.

It will be appreciated that the communication protocols utilized between the various components and the configuration of the communication ports and links may vary dependent primarily upon the configuration of the components. For example, if the printer 116 is configured as a USB type device, a USB communication protocol and associated ports may be utilized. In other embodiments, parallel, serial or other communication protocols and configurations may be utilized. The communication links may be wired or wireless.

In one embodiment, a communication link C7 is provided between the SCI 200 and the I/O board 104. In a preferred configuration, the communication link C7 is established between the SCI 200 and a secondary SAS port of the master gaming controller 102. In particular, one common configuration for the master gaming controller 102 is to have two communication ports through which communications may be established using the SAS protocol. As indicated above, in a common gaming machine configuration, the master gaming controller 102 may communicate with the SMIB 120 via one of these ports, generally the "primary" port. In a preferred configuration, the SCI 200 is connected to the master gaming controller 102 via the secondary port.

Yet another communication link C8 is provided between the SCI 200 and at least one external device. Preferably, that device comprises at least one server 202. The SCI 200 may transmit information over this communication link C8 to the server 202 and/or receive information over this link from the server 202. It will be appreciated that the SCI 200 might be configured to communicate with more than one external device, such as more than one server or other sources of information, either via one or more communication links. In one embodiment, the server or servers 202 may include a game management system, a media management system and/or a feed of media content (such as television/cable).

In a preferred embodiment, the server or servers 202 performs validation/redemption functions. In such an embodiment, the server or servers 202 may communicate with one or more external SMIBs 203, which SMIBs 203 are in communication with the gaming system external server 122 (which may perform host accounting and/or player tracking functions, among others). The number of external SMIBs 203 may vary, such as to ensure that a sufficient number of SMIBs exist to process transactions forwarded by the SCI 200.

It will be appreciated that the SCI 200 may communicate with one or more external devices, such as through the server 202. For example, as described below, the SCI 200 might transmit secondary game information through the server 202 to a remote website or a player's presentation device. In this manner, the SCI 200 may exchange information with external devices, including to control those devices and/or receive instructions/data from those devices.

Power may be provided to the SCI 200 from a dedicated power source or via the power source S to the gaming machine.

In this configuration, the interposition of the SCI 200 into the gaming machine does not interfere with the normal operation of the gaming machine. In particular, the gaming machine may present one or more wagering games or other events or activities to a player, as the gaming machine was originally designed. For example, in the presentation of a game, the master gaming controller 102 generates game data for display by the display 112. This data is simply transmitted to the I/O board 104 and then along communication links C3 and C4 to the display 112, through the SCI 200. Likewise, a player's touch input to the touch screen 114 is transmitted to the master gaming controller 102 via communication links C5 and C6 through the SCI 200.

In one embodiment, various features of the invention may be implemented through the SCI 200. The SCI 200 may connect to a casino server, such as casino server 24 or casino server 202. In this manner, information associated with primary and/or secondary gaming functionality which is obtained at the casino gaming machine 26 by the SCI 200 may be provided to the casino server, one or more remote servers, one or more remote computing devices or presentation devices 22. Additionally, information associated with primary and/or secondary gaming functionality obtained by the casino server from another computing device, e.g., a remote server and/or presentation device 22, may be provided to the casino gaming machine 26 via SCI 200. By way of a non-limiting example, such information might comprise information regarding game play associated with the primary and or secondary game instances provided by machine 26. For simplicity sake, information regarding primary and secondary gaming functionality may be referred to herein collectively and gaming functionality information. Gaming functionality information might comprise, for example, information regarding a player input, game selections, wagers, etc., and/or output generated by the gaming machine, such as casino gaming machine 26, which information may include game display output, primary gaming functionality options, secondary game functionality options, etc.

By way of further non-limiting examples, gaming functionality information may be transmitted from a casino server 24 via a communication link to an SCI 200 of a casino gaming machine 26, thus permitting the SCI 200 to update a state, e.g., game state and/or state of play, of the casino gaming machine 26 in accordance with the gaming functionality information.

As one example, the SCI 200 may capture gaming functionality information and route such information to a casino server 24, which server may be connected to the Internet, and/or another network, may communicate with the player's presentation device 22. Similarly, the casino server 24 may receive gaming functionality information from the player's presentation device 22 via the Internet, and/or another network, and forward such information to SCI 200.

A player might communicate with the SCI 200 of a casino gaming machine 26 via a casino server 24, which server 24 supports a website comprising one or more web pages for display at a presentation device 22. The website allows the player to play primary and/or secondary games provided by a particular casino gaming machine 26 by, for example, communicatively linking a computing device, such as a presentation device 22, to the selected machine in such a way as to interact with the gaming functionality provided by the selected machine. Once linked, the SCI 200 of the selected machine may provide output generated by the gaming functionality of the selected machine to a presentation device 22 being used by the player and to receive input provided by the player via the presentation device 22.

SCI 200 may communicate with player tracking server 42 to provide player tracking information. As is discussed herein, user/player identification information may be provided in the course of a player's interaction with a casino gaming machine 26, which information may be communicated by SCI 200 to player tracking server 42.

As indicated herein, in one or more embodiments, aspects of a player's activities may be tracked. In one embodiment, a player's casino gaming activities may be tracked by a player tracking system, such as via the player tracking server 42. Such systems are well known in the art and are thus not described in detail herein.

Figure 2:
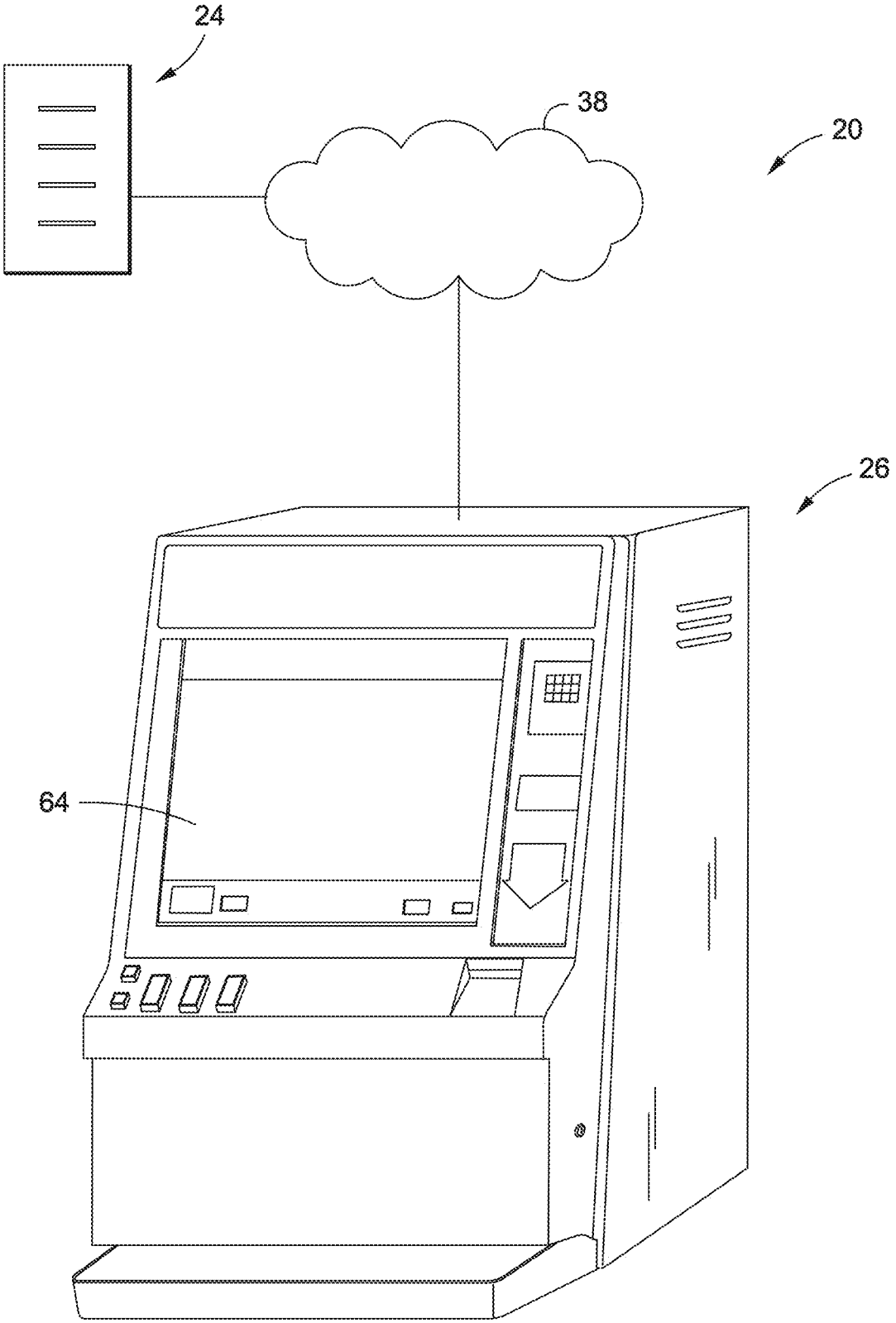
FIG. 2 diagrammatically illustrates a casino gaming machine having secondary gaming functionality.

FIG. 2 illustrates a casino gaming machine 26 having primary and secondary gaming functionality. In the example shown, display 64 of a casino gaming machine 26 may output a single-game together with one or more controls or triggers selectable by the player to enter or initiate a multi-game experience. In response to player input signaling a desire for the multi-game experience, display 64 may be modified to display multi-game output. By way of a non-limiting example, display 64 may be a touch-screen display, and the player may invoke the multi-game experience by touching a region of the display, such as by using the display 64 to hold a card, provide wager input, touch or select a "multi-game" icon/button, etc.

Figure 3:
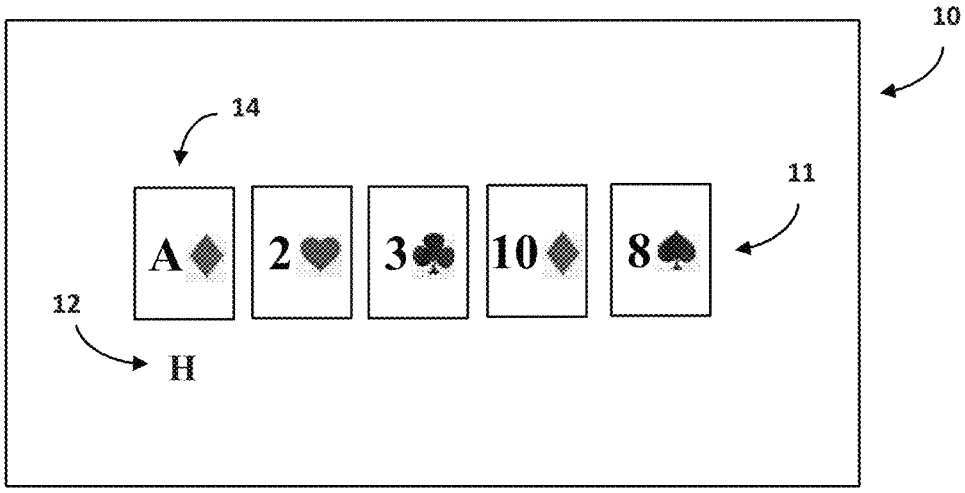
FIG. 3 diagrammatically illustrates a user interface comprising a video poker primary game display.

In accordance with one or more embodiments, a multi-game experience may be provided at the modified gaming machine 26. SCI 200 may be configured to display a multi-game user interface in response to player input. By way of one non-limiting example, the user interface may comprise multiple sections, or areas, each corresponding to a game being provided as part of the multi-game experience. FIG. 3 provides an example of a user interface 10, which may be displayed on display 64 of machine 26 in accordance with one or more embodiments. Initially, user interface 10 displays output for a primary or original game, which game may be provided via the primary gaming functionality of machine 26. Icon 12 is displayed in response to the player's holding of a particular card, e.g., card 14, which may also trigger SCI 200 to turn the game into a multi-game experience comprising the primary game and one or more additional games. In a case of video poker, the primary and secondary games in the multi-game experience each have a video poker hand. In so doing, the single-hand game may be turned into a multi-hand game, and the player is provide with an ability to play multiple hands.

While embodiments are described with reference to using a hold operation to trigger the multi-game experience, it should be apparent that other input, an occurrence of a designated event, etc. may trigger the multi-game experience. By way of a non-limiting example, a multi-game experience might be triggered from an occurrence of a designated event, e.g., appearance of a designated card in hand 11. For example, the SCI 200 and/or server 202 may be configured to detect the occurrence of one or more events in the main game and, in response thereto, trigger the one or more secondary games or events. The event might be designated by the player or machine 26 might be configured with one or more events, for example.

Figure 4:
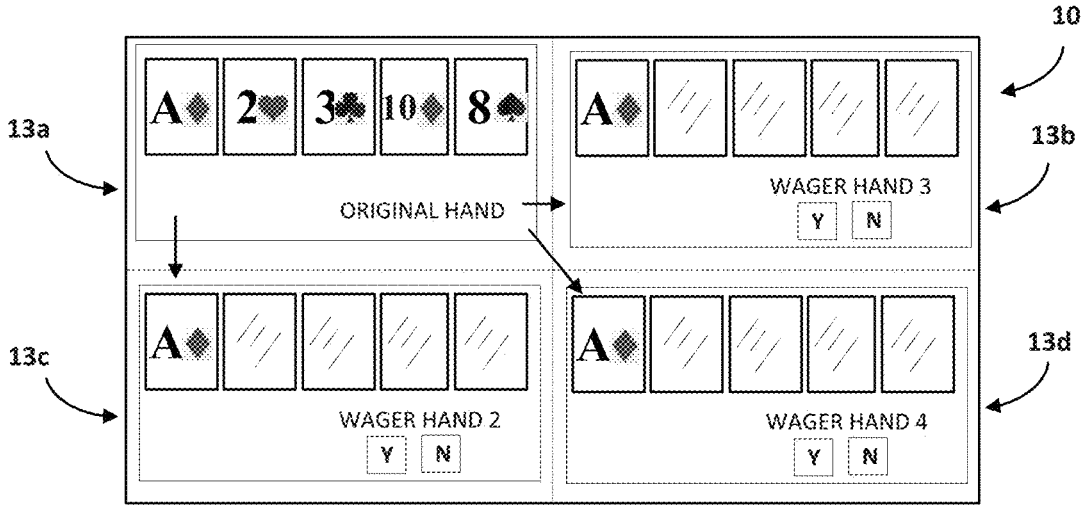
FIG. 4 diagrammatically illustrates a user interface comprising multiple sections, or areas, each of which displays a video gaming instance in a video poker multi-game output using primary and secondary gaming functionality.

FIG. 4 provides an example of a user interface 10 after the SCI 200 causes display 64 of machine 26 to display multiple video poker hands for the multi-game experience. In the example shown in FIG. 4, user interface 10 is split into multiple sections, or areas, 13, each of which displays one of the multiple hands. Area 13*a* of user interface 10 displays the original hand, and three additional hands are displayed in areas 13*b*, 13*c* and 13*d*. In the example shown in FIG. 4, each additional hand includes card 14 held in the original hand 11; however, it is also possible that one or more of the additional hands may share none or more than one card from the original hand 11 (by way of a specific additional example, a player might hold three cards from the original hand and those three cards may be re-used in one or more additional hands).

Of course, it should be apparent that the multi-game experience shown in FIG. 4 is exemplary, and many variations are conceivable. By way of one example, the multi-game experience may comprise more or less hands and/or the additional hands may be displayed such that some or a portion of one hand may be overlaid or superimposed on some or all of another one or more hands. It should be apparent that any windowing option may be used in displaying output in connection with the multi-game experience. In one embodiment, the one or more additional hands might utilize the one or more cards which are not held by the player from the base hand.

Referring again to FIG. 4, the example illustrates a case in which a card 14, or more than one card, from the original game may be passed to each of the additional games in the multi-game experience. Alternatively, a multi-game experience may be provided where no cards are passed from the original game to the additional games. In accordance with this multi-game experience, the player is provided with additional play possibilities simultaneously. The additional games may be displayed in the same display locations of a user interface 10 illustrated in FIG. 4; however, card 14 is not passed to each of the additional games. Instead, the player is given the impression of playing four separate games simultaneously, whereby the player is able to press deal and independently hold cards in each hand dealt, and press draw for an outcome for each one of the games in the multi-game experience.

In the example of FIG. 4, the multi-game experience is triggered by a player's holding a card. By way of a non-limiting example, the player might be given an opportunity to bet in each game, and reach an outcome in a game in response to providing the bet input (wherein each outcome may comprise a losing outcome or a winning outcome, wherein a winning outcome may have an associate payout or winning award to the player). Alternatively, the player may be given an opportunity to place a bet across all of the hands, such that game outcomes are played simultaneously for all of the hands. For example, when one or more additional games are triggered, the player may be given the option of playing the one or more additional hands by placing one or more wagers, such as a wager upon each additional hand. If the player does not elect to place such additional wager(s), the game may revert back to the primary game. In another configuration, the one or more secondary or additional games may be presented without the requirement of the player placing an additional wager. In addition, the payouts or winning awards for the primary and secondary game(s) may be the same or different, such as depending upon whether a wager is required.

Figure 5:
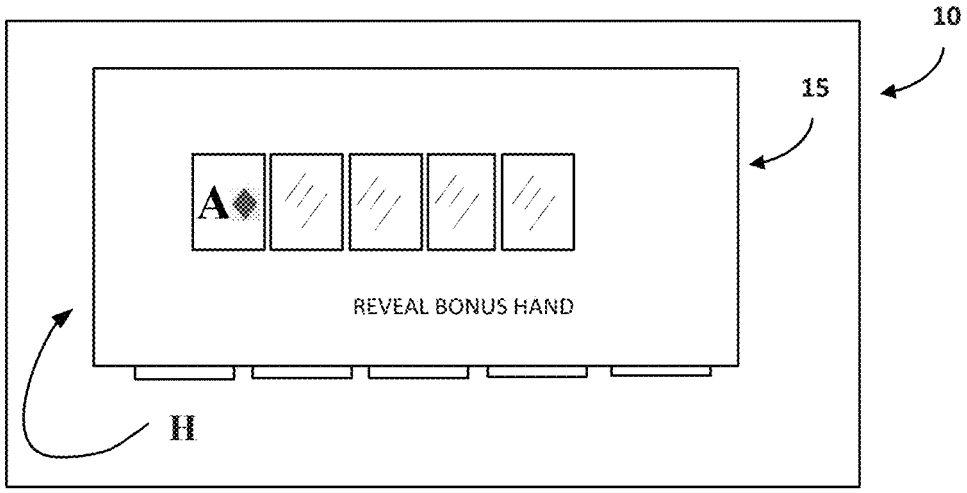
FIG. 5 diagrammatically illustrates a user interface displaying multiple video poker game instances, one of which is superimposed on another.

FIG. 5 provides another example of a user interface 10 after the SCI 200 causes display 64 of machine 26 to display multiple hands in response to an occurrence in connection with an original game or hand, such as for example, a player's holding a particular card, etc. In the example shown in FIG. 5, an occurrence of an event, such as the player's holding of card 14, results in SCI 200 triggering a second game, such as a bonus game. The bonus game display 15 might be overlaid, or superimposed on, the original game's display in user interface 10, such as is illustrated in FIG. 5. It should be apparent that the bonus game's display 15 might be displayed in another location or fashion, such as without limitation alongside the original game's display, above, below, underneath, etc. the original game's display. In the preferred configuration of this embodiment, the bonus game is such—i.e. does not require the player to place an additional wager to be play the bonus game and have the chance for additional winnings.

Figure 6:
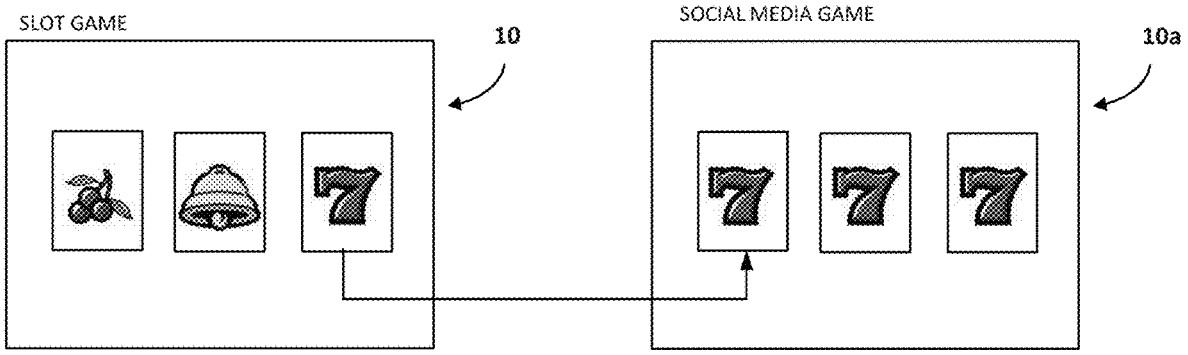
FIG. 6 diagrammatically illustrates an interface displaying a primary game user interface and a second user interface displaying a social media game spawned from the primary game.

As discussed herein, secondary gaming functionality provided via SCI 200 may involve presentation of one or more additional games, which additional games may be experienced at a computing device other than machine 26. User interface 10 shown in FIGS. 4 and 5 might be output at a presentation device 22, for example. In the example shown in FIG. 6, the original game provided by the primary gaming functionality of machine 26 is a slot game, and the multi-game experience includes a slot game accessible via a social media web site using a presentation device 22. In the example shown in FIG. 6, one of the slot symbols of the original slot game shown in user interface 10 is used in the social media game output shown in user interface 10*a*. Other variations are conceivable, including without limitation none or more than one symbol from the original game might be shared with the social media game.

By way of some further non-limiting examples, a held card, wager input, etc., made in an original game may be used to advance progress in a secondary game, e.g., a secondary game presented at the modified gaming machine 26 or in a secondary social media game.

It will also be appreciated that the primary game and one or more secondary games may have the same or different features, such as the same or different pay tables, game rules or the like. As one example, the primary game may be a game of Deuces Wild video poker while the one or more secondary games may be implemented as games of Double Double Bonus video poker. In one embodiment, the one or more cards which are used in the primary game may the same or different from those used in the one or more secondary games. For example, one virtual deck of cards may be used in the play of the primary and secondary game (i.e. all cards displayed to the player in all hands are drawn or selected from a single virtual deck) or the cards in each game might be selected from different virtual decks.

In accordance with one or more embodiments, the multi-game experience may include a separate gaming system, such as a server-based gaming system or another gaming machine 26, etc. By way of a non-limiting experience, one or more additional games in the multi-game experience might be managed by the separate gaming system while the original game is managed by the initial, "original", gaming machine 26. The SCI 200 of the original gaming machine 26 may communicate with the separate gaming system, such as via one or more networks and servers, to instruct the separate gaming system to commence the multi-game experience.

In a case of a server-based system, the additional games may be presented to the player using a presentation device 22, for example. The separate gaming system may communicate directly with the player's presentation device or indirectly via a SCI 200 of a gaming machine 26, e.g., the original machine 26. By way of one non-limiting example, when the multi-game experience is triggered at the original machine 26, the machine's SCI 200 might respond and instruct the separate gaming system to create one or more additional game instances. Where the original game is a video poker game, the SCI 200 may instruct the separate gaming system to use one or more hold cards from the original game. In accordance with one or more embodiments, the additional game instances created by the separate gaming system might be managed by the separate gaming system. Alternately, the SCI 200 of the original machine 26 might maintain some control over the management of the additional games and/or the multi-game experience.

As discussed herein, in a multi-game experience in accordance with one or more embodiments, additional games may be spawned, or branched off, from an existing game. Alternatively, a multi-game experience may involve permitting a player to engage in multiple types of wagers on an existing game. In so doing, the primary gaming functionality may be modified using secondary gaming functionality that modifies a manner in which the player is able to bet on the primary game.

Of course, primary gaming functionality could be modified in various manners, such as to overcome various types of shortcomings or limitations of an existing primary game. For example, as indicated herein, an existing primary game might be limited to a single hand of video poker. In accordance with the invention, that primary game could be modified into a multi-hand game of 2, 10, 100 or more games. In addition, it will be appreciated that the secondary game functionality/features need not be the same as the primary game. For example, while secondary features might comprise additional hands of video poker relative to a primary video poker game, the secondary feature might be a video-slot game which is triggered off of a primary video poker game.

In another embodiment of the invention, the secondary gaming functionality which is implemented via the secondary controller may comprise a secondary award or bonus, such as a fixed or variable award, a jackpot, a progressive jackpot, a multiplier and other types of awards.

By way of a non-limiting example, a "double up", or other betting multiple, may be provided via the secondary gaming functionality provided by SCI 200. A player might opt to try to double, triple, etc. an amount. The actual multiple might be selectable by the player. By way of a further example, the player may opt to try to double their winnings, such as in a case that a Four-of-a-Kind ("FOK") or Royal Flush event occurs with the player's hand in the original game. By way of a further non-limiting example, where the player makes a side bet such as this, and a FOK or Royal Flush is dealt to the player, the player might win the multiple of the "pay table" amount. The additional wager experience may involve a separate gaming system, such as a server-based gaming system. In such a case, the separate gaming system might manage a side bet as though it is a separate game played on the system that occurs contemporaneously with the original game being played.

As another non-limiting example, in one unique implementation, a bonus such as a multiplier or a progressive jackpot might be offered in conjunction with a base game (e.g. a game which the gaming machine is configured to present in its base configuration, such as via the master gaming controller 102) even though the base game/gaming machine is not configured to offer such an award or bonus. As another example, the invention may be utilized to modify or enhance an award or bonus which the base game/machine offers.

As one example, the SCI 200 may be utilized to present a bonus in association with a base game which is presented by the master gaming controller 120 of the gaming machine. As indicated above, gaming machine has a base configuration in which it is configured to accept monetary value which can be used by a player to place wagers on a wagering game presented by the gaming machine. This wagering game or "base" game may comprise any number of games such as a slot game, video poker game or the like.

As another example, the master gaming controller 120 of a legacy gaming machines may be configured to present a video poker game to a player. The video poker game might offer a pay table of winnings based upon Jacks or Better poker hands, such as having the following winning hands and awards: Jack or Better—1 credit; 2 Pair—2 credits; 3 of a Kind—3 credits; Straight—4 credits; Flush—6 credits; Full House—9 credits; 4 of a Kind—25 credits; Straight Flush 50 credits; and Royal Flush—250 credits. The player might elect to play the video poker game by making a 1 credit wager on the game via the master gaming controller 120.

The player might also have the option of placing a side wager via the SCI 200. In particular, the SCI 200 might offer, for example, a side bet option where if the outcome of the base video poker game is a Full House of Aces and Jacks, the player is awarded a jackpot of $1000 (or equivalent credits). The player might elect to place this side wager by placing a 1 credit wager via the SCI 200.

The master gaming controller 120 present the video poker game. As one example, the outcome of the game might comprise a Full House comprising the hand: A♣A♠J♥J♦J♠. Because the player received a Full House game outcome, the master gaming controller 120 would award the player winnings based upon the pay table—e.g. the player would be awarded 9 credits. At the same time, the SCI 200 would "see" (via it's monitoring of the master gaming controller 120) this Full House game outcome and that it comprised a Full House of Aces and Jacks. As such, the SCI 200 would separately determine that the side bet was winning and award the player a secondary award or bonus of $1000.

As noted herein, different player credit balances might be tracked by the master gaming controller 102 and the SCI 200. For example, in the above embodiment the player might have a first or primary $100 credit balance associated with the master gaming controller 102 and a second or secondary $50 credit balance associated with the SCI 200. After the player placed the 1 credit/$1 wager with the master gaming controller 102 on the video poker game, the player's primary credit balance would be $99. After the player placed the 1 credit/$1 wager with the SCI 200 on the side bet, the player's secondary credit balance would be $49. Then after the master gaming controller 102 awarded the player 9 credits for a winning Full House on the video poker game, the player's primary credit balance would be $108. After the SCI 200 awarded the player 1000 credits for the winning side bet, the player's secondary credit balance which is associated with the SCI 200 would be $1049.

It will be appreciated from this example how the SCI 200 presents the secondary gaming functionality, such as the wager-based secondary bonus or award in this example, in a manner which does not alter or interfere with the operation of the master gaming controller 102 and its presentation of games. In particular, in this example, the player's election to place a side bet via the SCI 200 does not alter or change in an way the presentation of the video poker game which is presented by the master gaming controller 102. In fact, the master gaming controller 102 is not aware of the SCI 200 or the secondary wager placed by the player. The master gaming controller 102 thus presents the video poker game as though the gaming machine did not include the SCI 200. At the same time, the SCI 200 and not the master gaming controller 102 determines the outcome of the secondary wager based upon the criteria for the secondary wager or secondary gaming functionality.

It is noted that in the normal gaming configuration, a portion of wagers which are placed on the base game are retained as losing wagers and a portion of the wagers which are placed on the base game are paid out in the form of winnings. Typically, a base game will have a hold of around 5-7%, e.g. about 93-95% of all wagers are returned as winnings and the 5-7% hold represents gaming machine revenue. The winnings which are paid out are defined by a pay table for the base game. This pay table defines winning outcomes and associated awards. Unfortunately, the pay table for the base game is static and may not offer awards which are very exciting for a player. For example, the base game might pay back a high percentage of winnings, such as 97%, in the form of frequent but low value payouts. These payouts may not be very attractive to some players.

In accordance with the invention, the SCI 200 may be utilized to offer one or more bonuses, such as win multipliers or jackpots. In the case of jackpots, the jackpots might be a fixed value or progressive, e.g. grow or increase over time or based upon other criteria. In accordance with the invention, the one or more secondary bonuses may be funded by secondary wagers. In particular, in accordance with the invention described herein, a player may associate monetary value with the gaming machine and can designate that value as secondary credits which can be wagered by the player to participate in the bonus which is implemented by the SCI 200.

In one embodiment, a player may make a payment or a secondary bonus wager (in addition to one or more wagers upon the base or primary game(s) offered via the master gaming controller 102) in order to implement or enable the secondary gaming functionality. A portion of each secondary payment or bonus wager may be used to fund one or more jackpots or bonuses (and a remaining portion might be held as revenue). For example, the master gaming controller 102 of the gaming machine might offer a base game of video poker wherein certain poker hands are designated as winning and have associated fixed awards. In accordance with the invention, the SCI 200 might be utilized to offer a progressive jackpot award to a player if the player receives one or more designated outcomes of the base video poker game. Such outcomes might comprise one of the designated winning outcomes of the base game or another outcome. As one example, the SCI 200 might be configured to offer a progressive jackpot to a player if the player receives a Royal Flush poker hand in the base game.

As one example, a player might be required to place a $1 secondary wager to qualify for the secondary bonus via the SCI 200. A portion of each wager, such as $0.50 might be attributed to a progressive jackpot. Thus, each wager causes the progressive jackpot to increase until it is won by a player. Of course, the SCI 200 might offer progressive jackpots with a seed or base amount, might offer fixed bonuses or more than one bonus or jackpot, wherein the secondary wagers placed by players may be used to fund those bonuses or jackpots. The SCI 200 might also offer or award multipliers of a base game outcome (e.g. a player might place a $1 secondary wager and might win a 5× multiplier of a base game win (such as $10; whereby the player receives $10 in base game winning credits and a $50 multiplier win, such as in the form of secondary credits associated with the SCI 200).

Advantageously, the SCI 200 is capable of detecting base game activity, such as whether the required maximum bet has been placed on the base game (if such is required) and the outcome of the base game, for determining whether a player qualifies for the bonus and/or has received bonus winning outcome, in the manner described above. Also, using a secondary accounting server or system, the monetary value which the player associates with the gaming machine and designates for use as secondary credits used to wager on the secondary games or bonuses can be tracked and accounted for (e.g. the system enables segregated accounting for the bonuses or jackpots which are implemented via the SCI 200 from the base game and the wagers and winnings associated with the base game).

As another example, the SCI 200 might enhance an existing bonus which is offered via a base game. A base game might already have an associated bonus, such as a progressive jackpot. The amount of the base jackpot might increase, such as based upon a portion of the base game wagers. In accordance with the invention, this jackpot might be increased by a portion of secondary wagers placed via the SCI 200. A player who places the required main game wager might win the base jackpot but a player who places the required main game wager and a required secondary wager might win the entire jackpot, e.g. the base jackpot plus the jackpot increase.

Another advantage of the invention is that the player may be provided with options to select or control the bonus opportunity. For example, the SCI 200 may allow (such as via player input) the player to select the size of a bonus wager and thus the associated potential bonus payout. For example, the SCI 200 might offer a player a small bonus or 10% of a progressive jackpot for a secondary wager of $1, or a large bonus or 100% of a progressive jackpot for a secondary wager of $10. As another example, the SCI 200 might be configured to allow the player to "buy a multiplier" on a base game win, wherein the size of the purchased multiplier might depend upon the size of the secondary wager. In this regard, as detailed above, unlike the base game which has a fixed or static pay table, the SCI 200 can be configured (and re-configured at any time) to offer any number of bonuses which might be player-selectable, might change over time, etc.

Of course, in a multi-game environment, the PCUs 822 of a plurality of gaming machine may be linked via a common system, such as the above-referenced secondary account system or a bonusing system, whereby a system-wide bonusing or jackpot system may be enabled. In this fashion, secondary wagers placed at multiple gaming machines may be aggregated to create larger jackpots and/or multiple bonuses which can be awarded at the plurality of linked gaming machines.

As indicated, the secondary award or bonus might have various forms and be triggered in various manners. For example, the secondary award might increase or enhance an award which is associated with a winning primary or base game outcome, whereby the triggering event for the secondary award is the winning game base outcome. As one example, if a player receives a winning base outcome (which may have an associated base award), the player may also receive an additional secondary award, such as additional credits (a fixed number, a progressive jackpot, etc.) or a multiplier or multiplied value of the base award. In other embodiments, the secondary award might be triggered or won by receiving an outcome of the base game which his not designated as winning in the base game, or by some other event other than a particular game outcome.

As indicated herein, the primary and secondary wagering functionalities may both be implemented as wagering games or events. A player may associate funds with the gaming machine for funding the wagering. These funds may be represented by credits. The player may wager one or more credits to play a primary game and wager one or more credits to enable the secondary gaming functionality. In one embodiment, the credits might comprise primary credits which are tracked by the master gaming controller 120. For example, a player might input $20 to a bill validator of the gaming machine. In response, the master gaming controller 120 might credit the player with 80 credits (each worth $0.25). The player might wager 1 credit ($0.25) to play a primary video poker game. Upon receiving that wager, the master gaming controller 120 may reduce the number of remaining credits to 79. The player might also wager 1 credit to play a secondary game. The SCI 200 might receive input from the player and send a signal to the master gaming controller 120 to deduct another credit from the balance.

In another embodiment, a player may associate credits with the master gaming controller 120 and the SCI 200, whereby separate credit or monetary balances are tracked. For example, a player might input $20 to the gaming machine. The SCI 200 may intercept the signal from the bill validator 108 to the master gaming controller 120 of this input and allow the player (such as via information displayed on the display 112) to designate how the funds should be distributed. For example, the player might associate $10 (such as 40 credits each having a value of $0.25, by way of the SCI 200 sending a modified signal to the master gaming controller 120 that only $10 was input to the gaming machine) with the master gaming controller 120 and may associate the remaining $10 with the SCI 200. When the player makes a wager on primary gaming functionality, the master gaming controller 120 would then deduct credits from the credit balance which is tracked by the master gaming controller 120. On the other hand, when the player makes a wager on the secondary wagering functionality, the SCI 200 would deduct credits from the credit balance which is tracked by the SCI 200. Likewise, winning amounts would be associated with the respective credit balances. For example, a player might win $10 playing a primary game, raising the credit balance tracked by the master gaming controller 120, but leaving the credit balance tracked by the SCI 200 unchanged.

In this case, the credits which are associated with or tracked by the master gaming controller 120 may be referred to as primary credits and the credits which are associated with or tracked by the SCI 200 may be referred to as secondary credits. It is noted that the primary and second credits might have differing values. For example, the primary credits might each have a value of $0.25, while the secondary credits might each have a value of $1.00 or might simply comprise points or the like. In this regard, the primary and secondary wagers might have differing values, such as based upon a different number of credits which are wagered and/or the value of those credits.

In one embodiment, the monetary transactions which are implemented via the master gaming controller 102 (including primary credit wagers on primary games and winnings or primary credits awarded via the master gaming controller) may tracked by the master gaming controller 102 via a primary credit meter (which provides a primary credit balance which may be displayed to the player) and be reported to the primary accounting server 40. Monetary transactions which are implemented via the SCI 200 (including secondary credit wagers associated with secondary gaming functionality and winnings awarded by the SCI 200) may be tracked by the SCI 200 via secondary credit meter (which provides a secondary credit balance which may be displayed to the player) and may be reported to a secondary accounting server or system to which the SCI 200 is linked (in one embodiment, however, because the SCI 200 also "sees" all primary credit transactions by the master gaming controller 102, the SCI 200 may also track and report those transactions to the secondary accounting server or system). The primary and secondary accounting systems may communicate or the like, such as to reconcile transactions.

In this embodiment, any winnings which are paid as a result of a winning secondary wagering event may be paid from or "funded" as a portion of secondary credits which are wagered—e.g. the secondary wagers comprise a secondary source of funds which can be used to fund secondary awards. For example, the secondary wagering functionality may comprise a bonus wager on a primary video poker game which is presented by the master gaming controller 120. This bonus wager might have a pay table which pays out 96% (on average) of all secondary wagers which are made. This payout structure may be different from that of the primary game. For example, the pay table for the primary game, such as a primary video poker, game, might yield a 97% payback to the player (on average; whereby the house holds the remaining 3% on average). The secondary gaming functionality may thus enable the operator to achieve various goals. For example, the gaming machine may be natively configured to offer a primary wagering game which has a very low payback percentage to the player, such as 90%. This may cause the play level of the game to decrease. The operator might thus implement secondary gaming functionality, such as secondary awards for outcomes of the primary game, which cause the total average payout to rise to 95%. On the other hand, a primary game might have a payout percentage of near 98% and the operator might wish to add revenue from the gaming machine by implementing a secondary wager feature which has a payout to the player of 95%, thus providing an additional 5% hold to the gaming machine for the operator.

Of course, back-end accounting or other elements may be utilized to reconcile funds which are inputted into the gaming machine by the player and then distributed between the master gaming controller 120 and the SCI 200 (for example, so as to reconcile how $10 was associated with the master gaming controller 120 when the player input $20 into the gaming machine). Such a configuration is disclosed in co-pending U.S. application Ser. No. 14/550,241, filed Nov. 21, 2014, which is incorporated herein in its entirety by reference.

As noted herein, the secondary gaming functionality may vary. The secondary gaming functionality might comprise one or more of: (1) a second game which is unrelated to the primary gaming functionality or primary game (such as a second hand of video poker which is unrelated to a primary hand of video poker or a secondary keno game which is unrelated to a primary video poker game); (2) a second game which is related to the primary gaming functionality or game (such as by using one or more common cards or the like); and (3) a secondary or bonus wager, the outcome of which is dependent upon some aspect of the primary gaming functionality or primary game, such as upon the outcome of that game. The secondary gaming functionality might result in the award of monetary value awards (such as monetary value credits) and/or other prizes or awards, such as non-monetary value player tracking awards or reward points. These secondary awards might be provided separately from or in addition to any awards which awarded by the play of the primary wagering games as implemented by the legacy gaming machine.

In another embodiment of the invention, the secondary gaming functionality might comprise a payment or wager relating to primary wagering functionality or game play. For example, a player might be awarded player tracking or player reward points based upon their primary game play. For example, as indicated above, a player's game play activities may be tracked (such as via a player tracking server 42 based upon game play information reported by the master gaming controller 120). The operator might award the player reward points (such as to a reward points balance associated with a player's rewards account) based upon amounts wagered by the player, the types of games played by the player, amounts won or lost as a result of primary wagering game activity, or the like).

In one embodiment, a player might place a secondary payment or wager to enable secondary game functionality in the form of an opportunity for reward points. In one embodiment, a player might place a secondary payment or wager which causes the SCI 200 to implement secondary rewards functionality. This secondary rewards functionality may result in the award of one or more reward points to the player, such as via a player tracking server. As one example, the SCI 200 might implement secondary rewards functionality in the form of the opportunity for a multiple of the reward points awarded as a result of primary game play. For example, a player might wager $20 for the opportunity to be awarded double reward points during a 1 day game play period. Thus, if the player was awarded 1500 reward points as a result of primary game play (via the master gaming controller 120 and an associated player tracking server), the SCI 200 might cause the player to be awarded another 1500 reward points. In this configuration, the SCI 200 might also communicate with the player tracking server 42 so as to cause the player tracking system to award the points to the player's account. Of course, the player might be awarded other numbers or points or the like. For example, the secondary gaming functionality might be configured to award reward points in other numbers or amounts than is awarded by the gaming machine/system as a result of direct primary wagering game play. As one example, a player might be awarded 10 reward points for each credit wagered on primary game play. The secondary gaming functionality might award the player 50 reward points for each losing primary game outcome (whereby a player might place a secondary payment or wager which offers reward points for losing primary game play, such as during a certain number of games or a period of time). As another example, the secondary gaming functionality might award the player points at a different rate than the base or primary points rate. For example, a player might be awarded 10 points for each primary credit which is wagered (as reported by the master gaming controller 120 to the player tracking system/host, but the SCI 200 might cause the player to be awarded bonus point at a rate of 20 points for each primary credit which is wagered (such as by sending signals to the player tracking system/host which makes it appear that the player has placed additional primary credit wagers or via other mechanisms). As is the case with well-known player tracking systems, the player might use the awarded reward points to fund game play, to obtain goods or services (buffet passes, drinks, show tickets, etc.).

In one embodiment, the SCI 200 may cause the gaming machine display 112 to display a reward points offer. The offer, including the cost, type of award, etc., may vary based upon various circumstances, such as the player, the gaming machine, the time of day, etc. For example, a player might be given an offer to place a secondary wager of $10 for the chance to win double points (double the points awarded as a result of primary game play) on a Wednesday, but the same offer might cost $20 on a Saturday. This points feature might also be implemented by an operator to, for example, modify a gaming machine to make game play at the gaming machine be more appealing or exciting to the player. For example, as indicated, the operator might offer a player a chance for heightened points awards at certain times of day or the like, such as based upon a low secondary wager, in order to make game play during those times of day more appealing to players.

In one embodiment, the secondary gaming functionality might result in the award of both monetary awards and reward points to a player. For example, a player might place a secondary wager to play one or more secondary games. The SCI 200 might cause the player to be awarded reward points for the secondary wagers and/or secondary game activity (such as via the player tracking system) and be awarded monetary awards for secondary game wins. In another variation, the SCI 200 might cause the player to be awarded additional reward points which are based upon the primary game play or the primary game play and the secondary gaming functionality/game play. For example, a player might place a secondary wager via the SCI 200. The SCI 200 might then cause the player to be awarded double reward points to those awarded for primary game play (e.g. to reward an additional equal amount of points to those which are awarded because of game play reported by the master gaming controller 120) and might award reward points for secondary game play (such as points based upon the size of the player's secondary wager or number of secondary game plays, game wins, game losses, etc.).

In other cases, the SCI 200 could cause the player to be awarded reward points in situations where the player would otherwise not be awarded any reward points based upon their primary game activities. For example, the player tracking system and/or gaming machine might be configured so that the player is not normally awarded reward points for wagers less than $1.00. However, the SCI 200 might cause the player to be awarded reward points for wagers of $0.50. For example, the player might place a secondary wager or payment. The SCI 200 would then track the player's wagers on primary games played via the master gaming controller 200. The SCI 200 could report a wager of $1.00 to the player tracking system each time the player actually placed a wager of $0.50, thus causing the player to be awarded reward points for each primary wager/game.

As discussed herein in connection with one or more embodiments, secondary gaming functionality provided using SCI 200 may involve providing at least a portion of a multi-game experience using a social media system, server-based gaming system, another gaming machine 26, to a player's presentation device, etc.

In accordance with one or more embodiments, SCI 200 may connect with a social media server directly or indirectly to provide secondary gaming information to the social media server. By way of a non-limiting example, secondary gaming information may comprise game content, information identifying one or more seed cards, wagering information, etc. By way of a further non-limiting example, some or all of the secondary gaming information might be used to share at least a portion of a player's multi-game experience with the player's social media friends. In some embodiments of the invention, the player's "friends" may participate in the secondary game and/or make decisions which relate to the player's play of the secondary game. Likewise, information or content which is generated externally, such as at a social media server, may be provided to the gaming machine 26. For example, information about the multi-game experience shared with the player's social media friends may be transmitted from a social media server to the SCI 200 of the gaming machine 26, thus permitting that information to be utilized at, and/or displayed by, the gaming machine 26.

In a case that a server-based gaming system is used in providing at least some portion of a multi-game experience, SCI 200 may connect with a system server directly or indirectly to provide secondary gaming information, e.g., game content, seed card information, wagering information, etc., to the server. By way of a further non-limiting example, some or all of the secondary gaming information might be used by the server-based system to provide at least a portion of a player's multi-game experience at a presentation device 22. Likewise, information or content which is generated externally, such as at a system server, may be provided to the gaming machine 26. For example, information about the multi-game experience provided by the server-based system may be transmitted from a system server to the SCI 200 of the gaming machine 26, thus permitting that information to be utilized at, and/or displayed by, the gaming machine 26.

By way of further illustration, where a second gaming machine, e.g., a second modified gaming machine, is used to provide at least some portion of a multi-game experience, the first machine's SCI 200 may connect with the second machine, e.g., the second machine's SCI 200, either directly or indirectly, to provide secondary gaming information, e.g., game content, seed card information, wagering information, etc., to the second machine. By way of a further non-limiting example, some or all of the secondary gaming information might be used by the second machine to provide at least a portion of a player's multi-game experience at the second machine. Likewise, information or content which is generated at the second machine may be provided to the first machine, thus permitting that information to be utilized at, and/or displayed by, the first gaming machine.

As discussed herein, a modified gaming machine 26, and in particular the SCI 200, may communicate with one or more external devices, some or all of which may be remote with respect to the machine 26, via one or more network, including without limitation network 38 shown in FIG. 1. In an embodiment, network 38 may couple devices so that communications may be exchanged, such as between servers 24, 40 and 42, casino gaming machine 26, presentation devices 22 and/or other types of devices, including between wireless devices coupled via a wireless network, for example. Network 38 may include the Internet, one or more local area networks (LANs), one or more wide area networks (WANs), wire-line type connections, wireless type connections, or any combination thereof.

A wireless network may couple client devices with a network. A wireless network may employ stand-alone ad-hoc networks, mesh networks, Wireless LAN (WLAN) networks, cellular networks, or the like. A wireless network may further include a system of terminals, gateways, routers, or the like coupled by wireless radio links, or the like, which may move freely, randomly or organize themselves arbitrarily, such that network topology may change, at times even rapidly. A wireless network may further employ a plurality of network access technologies, including Long Term Evolution (LTE), WLAN, Wireless Router (WR) mesh, or 2nd, 3rd, or 4th generation (2G, 3G, or 4G) cellular technology, or the like. Network access technologies may enable wide area coverage for devices, such as client devices with varying degrees of mobility, for example. For example, a network may enable RF or wireless type communication via one or more network access technologies, such as Global System for Mobile communication (GSM), Universal Mobile Telecommunications System (UMTS), General Packet Radio Services (GPRS), Enhanced Data GSM Environment (EDGE), 3GPP Long Term Evolution (LTE), LTE Advanced, Wideband Code Division Multiple Access (WCDMA), Bluetooth, 802.11b/g/n, or the like. A wireless network may include virtually any type of wireless communication mechanism by which signals may be communicated between devices, such as a client device or a computing device, between or within a network, or the like.

As indicated herein, the features of the invention may be implemented at legacy gaming machines which offer various games, including video poker, video slots or various other games now known or later developed. For example, relative to a legacy game of video slots which only offers a single central pay line, secondary functionality may be added which allows a player to wager upon additional/other pay lines, or which offers the player An important aspect of the invention is that a primary game offered by a gaming machine is modified to include secondary game functions or features. In this manner, the actual primary game is modified (such as to transform it into a primary game with a bonus, a multi-hand primary game, a primary game with new wagering options, etc.) without actually modifying the actual primary game within the legacy gaming machine—e.g. without modifying the gaming machine's main controller and/or pre-existing software. Further, the secondary functionality is tied to the primary game and changes the primary game, rather than simply being an entirely separate feature or game which is simply presented independent of the primary game itself (for example, as contrasted with a secondary game which might be offered by placing a top box on an existing gaming machine, by which top box a progressive award might be awarded randomly or the like, apart from the base or primary game offered at the base gaming machine).

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A modified gaming machine comprising:

a housing;

a master gaming controller;

a plurality of gaming machine peripherals communicating with said master gaming controller via one or more communication links, at least one of said plurality of gaming machine peripherals comprising an electronic video display;

said master gaming controller configured to present a wager based main game based upon a wager of one or more primary monetary value credits associated with said gaming machine, said wager based game offering one or more base awards for winning outcomes of said main game, said base awards comprising one or more primary credits; and a secondary hardware controller added to the gaming machine to modify the gaming machine to implement one or more progressive jackpots, said secondary hardware controller in communication with one or more of said communication links, said secondary hardware controller configured to increment a value of at least one of said one or more progressive jackpots based upon a secondary wager placed with said secondary hardware controller and award at least a portion of at least one of said one or more progressive jackpots in the event a predetermined bonus opportunity winning outcome is generated by said main game.

2. The gaming machine in accordance with claim 1, wherein said predetermined bonus opportunity winning outcome comprises an existing winning outcome defined for said main game and said at least a portion of one or more of said one or more progressive jackpots is awarded in addition to a base award for said existing winning outcome.

3. The gaming machine in accordance with claim 1, wherein said predetermined bonus opportunity winning outcome comprises an outcome of said main game which is not defined as a winning outcome for said main game.

4. The gaming machine in accordance with claim 1, wherein said secondary wager is placed on a designated one of said one or more progressive jackpots and said award comprises at least a portion of said designated progressive jackpot in the event a predetermined bonus winning outcome is generated by said main game.

5. The gaming machine in accordance with claim 1, wherein said master gaming controller implements a primary credit meter of said primary credits and said secondary hardware controller implements a secondary credit meter of secondary credits.

6. The gaming machine in accordance with claim 5, wherein said secondary wager is placed as one or more secondary credits associated with said secondary credit meter and said at least one secondary award comprises an award of secondary credits.

7. The gaming machine in accordance with claim 1, wherein said master gaming controller implements a primary credit meter of said primary credits and said secondary wager comprises a wager of one or more of said primary credits associated with said primary credit balance.

8. The gaming machine in accordance with claim 1, wherein said secondary hardware controller is communicatively coupled to secondary hardware controllers of a plurality of other gaming machines, whereby said value of each of said one or more progressive jackpots is incremented based upon placement of secondary wagers at said gaming machine and said plurality of other gaming machines and whereby an award of at least a portion of said one or more progressive jackpots may be made at said gaming machine or any of said plurality of other gaming machines.

9. The gaming machine in accordance with claim 1, wherein said secondary hardware controller receives an output of said master gaming controller without communicating to said master gaming controller and analyzes said output of said master gaming controller to determine if said predetermined bonus opportunity winning outcome is generated by said main game.

10. The gaming machine in accordance with claim 1, wherein said plurality of gaming machine peripherals comprises a monetary value input device, said secondary hardware controller interposed along a communication path between said monetary value input device and said master gaming controller, said secondary hardware controller configured to generate a secondary credit balance from at least part of funds received by said monetary value input device based upon an output of said monetary value input device to said communication path, said secondary wager placed from said secondary credit balance, said secondary hardware controller configured to, at one or more times, forward information regarding funds received by said monetary credit balance to said master gaming controller for association with a primary credit balance maintained by said master gaming controller from which said primary wager is placed.

11. The gaming machine in accordance with claim 10, wherein an amount of funds which is associated with said secondary credit balance and an amount of funds which is associated with said master gaming controller is selected by said player based upon player input.

12. A secondary hardware controller configured to be added to a gaming machine to present secondary gaming functionality on the gaming machine without changing a wager based main game presented on the gaming machine, comprising:

a first interface configured to connect to a plurality of peripherals of the gaming machine including at least one video display; and a second interface configured to connect to a master gaming controller of the gaming machine which is configured to implement a wager-based main game based upon a wager placed with said master gaming controller, said wager-based main game offering one or more base awards for winning outcomes of said main game, said base awards comprising one or more primary credits; wherein said secondary hardware controller is configured to implement one or more progressive jackpots comprising incrementing a value of at least one of said one or more progressive jackpots based upon a secondary wager placed with said secondary hardware controller and awarding at least a portion of at least one of said one or more progressive jackpots in the event a predetermined bonus opportunity winning outcome is generated by said main game.

13. The secondary hardware controller in accordance with claim 12, wherein said at least one video display displays both information regarding said main game and information regarding said one or more progressive jackpots.

14. The secondary hardware controller in accordance with claim 12, wherein said secondary hardware controller analyzes an output of said master gaming controller to determine if said predetermined bonus opportunity winning outcome is generated by said main game.

15. The secondary hardware controller in accordance with claim 14, wherein said output comprises main game information.

16. The secondary hardware controller in accordance with claim 12, wherein said predetermined bonus opportunity winning outcome comprises an existing winning outcome defined for said main game and said at least a portion of one or more of said one or more progressive jackpots is awarded in addition to a base award for said existing winning outcome.

17. The secondary hardware controller in accordance with claim 12, wherein said predetermined bonus opportunity winning outcome comprises an outcome of said main game which is not defined as a winning outcome for said main game.

18. The secondary hardware controller in accordance with claim 12, wherein said master gaming controller implements a primary credit meter of said primary credits and said secondary hardware controller implements a secondary credit meter of secondary credits.

19. The secondary hardware controller in accordance claim 12, wherein said secondary hardware controller is communicatively coupled to secondary hardware controllers of a plurality of other gaming machines, whereby said value of each of said one or more progressive jackpots is incremented based upon placement of secondary wagers at said gaming machine and said plurality of other gaming machines and whereby an award of at least a portion of said one or more progressive jackpots may be made at said gaming machine or any of said plurality of other gaming machines.

* * * * *